US006026761A

United States Patent [19]

Parniske et al.

[11] Patent Number: 6,026,761

[45] Date of Patent: Feb. 22, 2000

[54] CANOPY MOUNTING SYSTEM

[75] Inventors: Dennis J. Parniske, Parrish; Robert R. Shearer, Ellenton; Albert W. Zirkelbach, Bradenton; Donald A. Zirkelbach, Sarasota, all of Fla.

[73] Assignee: Taylor Made Systems Bradenton, Inc., Bradenton, Fla.

[21] Appl. No.: 09/010,258

[22] Filed: Jan. 21, 1998

Related U.S. Application Data

[60] Provisional application No. 60/036,802, Jan. 31, 1997.

[51] Int. Cl.[7] ..... B63B 17/00

[52] U.S. Cl. ..... 114/343; 114/361

[58] Field of Search ..... 114/361; 383/63; 135/119; 24/583

[56] References Cited

U.S. PATENT DOCUMENTS

| | | | |
|---|---|---|---|
| 622,220 | 4/1899 | Goldsborough . | |
| 2,937,652 | 5/1960 | Zimmer et al. | 114/361 |
| 2,961,725 | 11/1960 | McGee | 114/361 |
| 2,975,496 | 3/1961 | McGraw | 24/201 |
| 3,038,225 | 6/1962 | Ausnit | 24/201 |
| 3,068,939 | 12/1962 | Commisso | 160/392 |
| 3,172,419 | 3/1965 | Lewis | 114/361 |
| 3,345,709 | 10/1967 | Bearman | 24/208 |
| 3,364,530 | 1/1968 | Kraus | 24/201 |
| 3,373,464 | 3/1968 | Ausnit | 24/201 |
| 3,486,788 | 12/1969 | Benton | 114/361 |
| 3,595,949 | 7/1971 | Staller | 264/146 |
| 3,918,131 | 11/1975 | Ausnit | 24/201 C |
| 4,046,408 | 9/1977 | Ausnit | 285/188 |
| 4,074,492 | 2/1978 | Simpson et al. | 52/419 |
| 4,199,845 | 4/1980 | Ausnit | 24/201 C |
| 4,268,938 | 5/1981 | Walchli | 24/201 C |
| 4,354,541 | 10/1982 | Tilman | 150/3 |
| 4,372,014 | 2/1983 | Simpson | 24/201 C |
| 4,578,813 | 3/1986 | Ausnit | 383/65 |
| 4,660,259 | 4/1987 | Ausnit | 24/587 |
| 4,673,383 | 6/1987 | Bentsen | 493/381 |
| 4,731,911 | 3/1988 | Gould | 24/557 |
| 4,787,880 | 11/1988 | Ausnit | 493/213 |
| 4,792,240 | 12/1988 | Ausnit | 383/63 |
| 4,846,585 | 7/1989 | Boeckmann et al. | 383/5 |
| 4,878,763 | 11/1989 | Ausnit | 383/65 |
| 4,898,492 | 2/1990 | Janowski | 403/340 |
| 4,939,819 | 7/1990 | Moyer | 24/16 R |
| 4,944,072 | 7/1990 | Robson | 24/587 |
| 5,070,584 | 12/1991 | Dais et al. | 24/587 |
| 5,215,032 | 6/1993 | Ellis et al. | 114/361 |
| 5,367,977 | 11/1994 | Ellis et al. | 114/361 |
| 5,425,327 | 6/1995 | Zirkelbach et al. | 114/361 |
| 5,622,136 | 4/1997 | Zirkelbach et al. | 114/361 |
| 5,774,955 | 7/1998 | Borchardt et al. | 383/63 |

FOREIGN PATENT DOCUMENTS

| | | |
|---|---|---|
| 1092452 | 11/1964 | United Kingdom . |

*Primary Examiner*—Stephen Avila
*Attorney, Agent, or Firm*—Nixon & Vanderhye P.C.

[57] ABSTRACT

The present invention is an improved arch for a boat. The improved arch includes at least one channel which extends at least partially along the port and starboard sides of the arch and at least partially across the top member of the arch. The channel is designed to receive water and direct that water away from the cockpit area of the boat. Additionally, the present invention includes a canopy mounting system particularly adapted for the arch of the present invention. The system includes a first locking strip attachment to a surface. The first member includes at least one fastening channel having a restricted opening. A locking member is adapted to be attached to a canopy and has at least one locking flange for insertion into the fastening channel of the locking strip. The canopy can be repeatedly connected to and disconnected by positioning the locking member against the locking strip and pressing against the locking member to force flanges into the fastening channel of the locking strip. The locking member can be removed from the channel by pulling the locking member away from the channel to disengage the flange from the fastening channel. The locking member is particularly well-suited for use with the boat arch.

26 Claims, 7 Drawing Sheets

Fig. 2
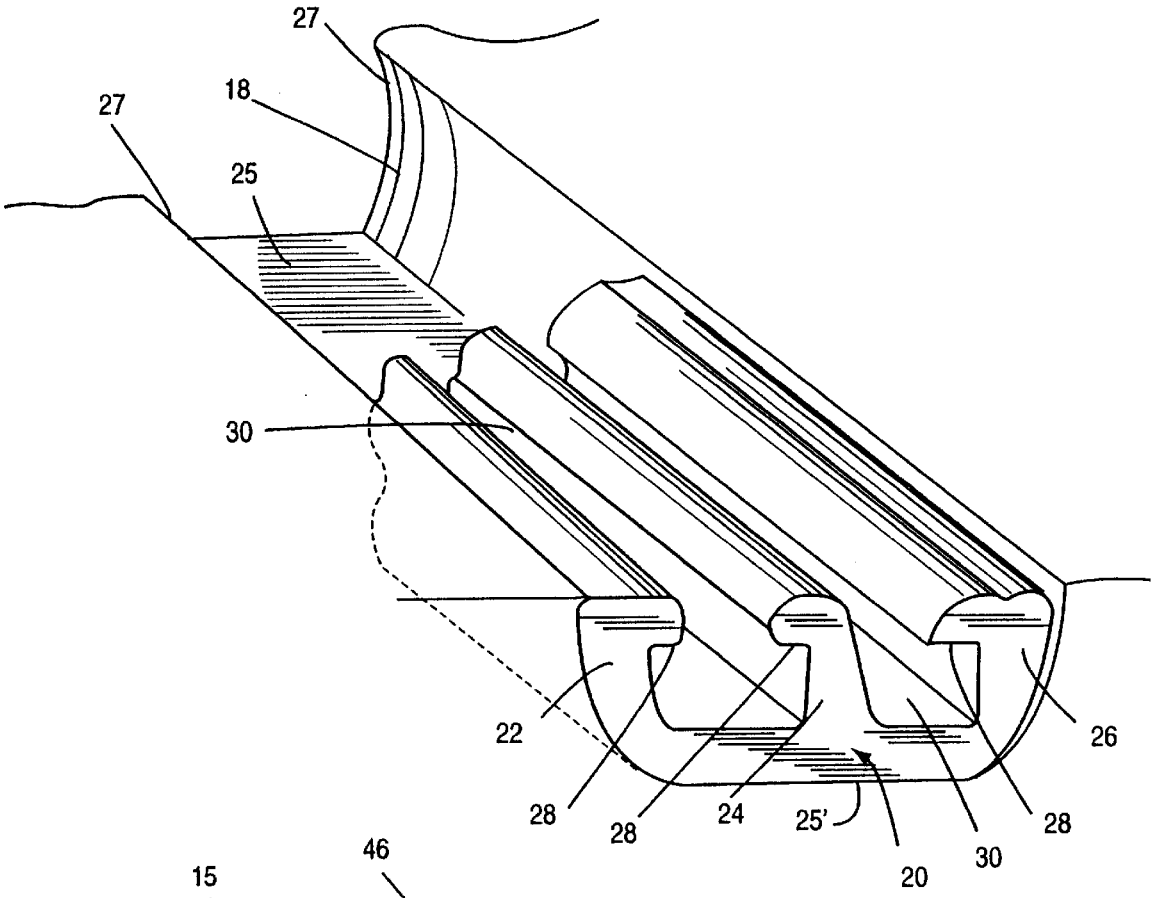
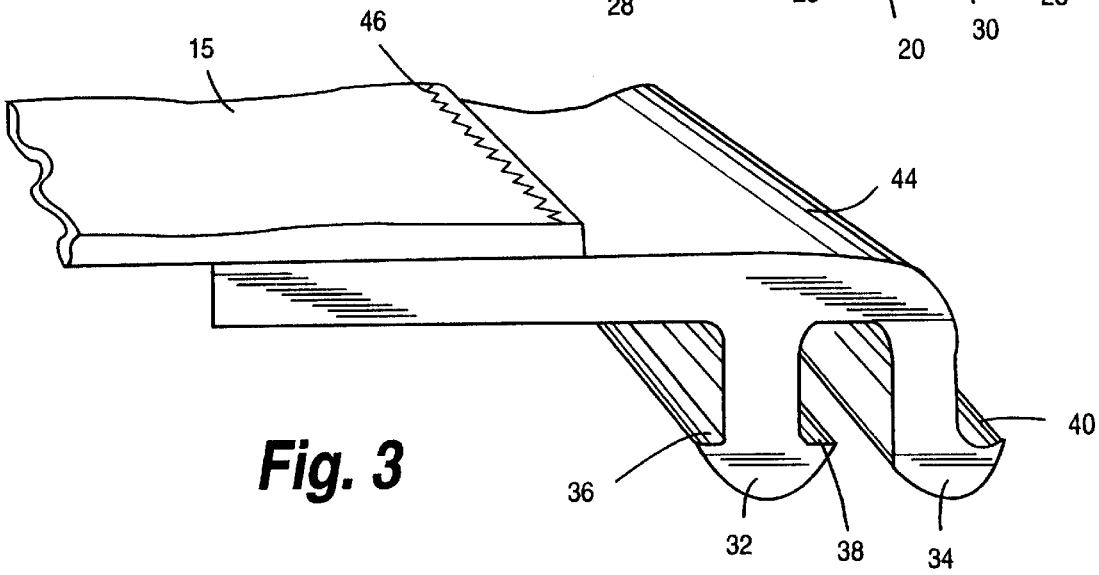
Fig. 3

Fig. 4
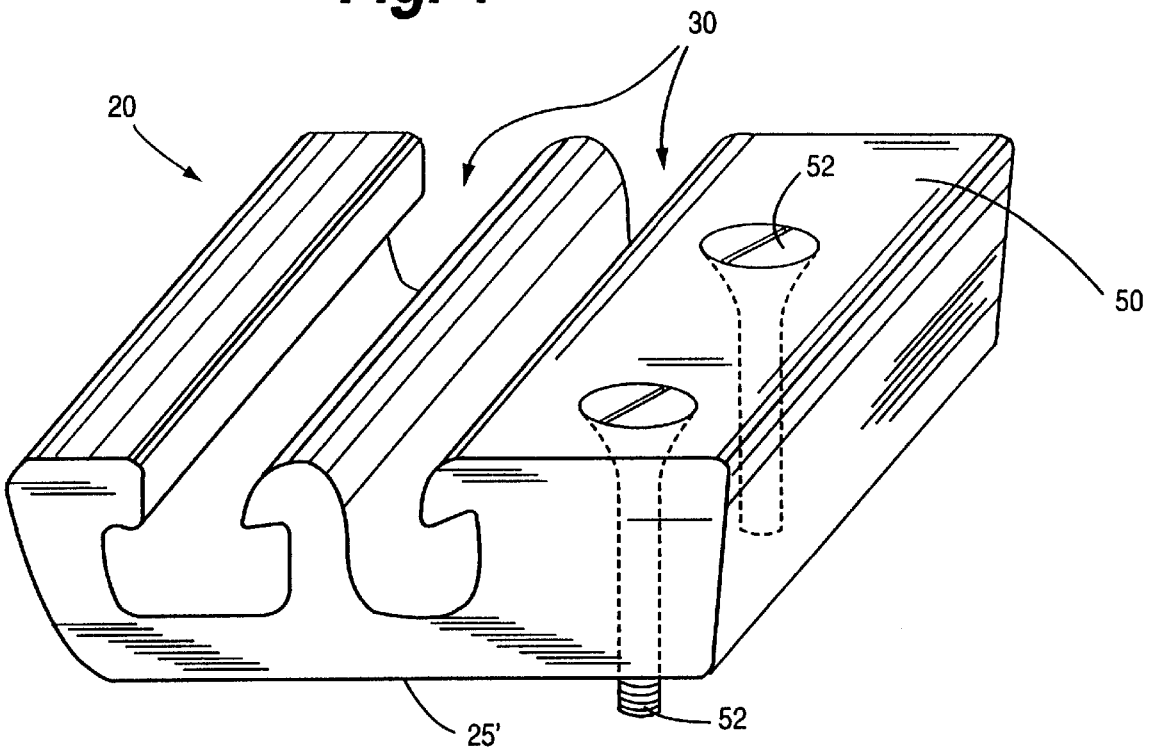
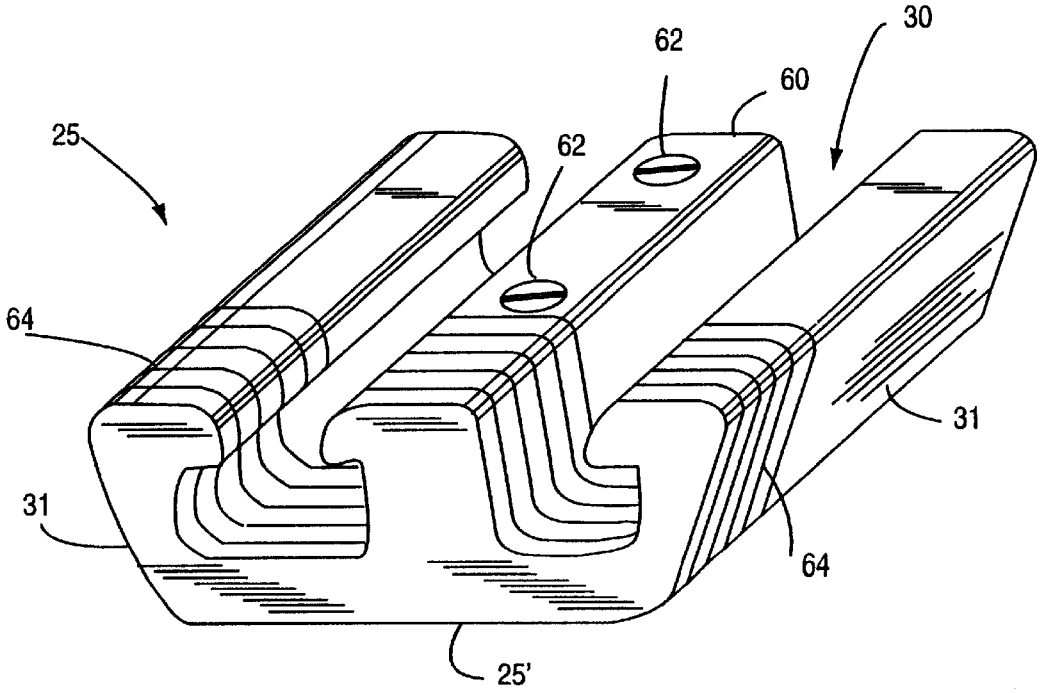
Fig. 5

CANOPY MOUNTING SYSTEM

This application claims priority of provisional application 60/036,802 filed on Jan. 31, 1997 entitled Canopy Mounting System for Arches.

BACKGROUND

The present invention relates to an improved canopy mounting system and more specifically to an improved boat arch system with an improved canopy mounting system.

One of the difficulties with boat arches is that water can hit the arch and be directed into the boat cockpit area. Typically, water sprayed by the boat contacts the arch, accumulates and then is sprayed across and drips into the cockpit area.

A further problem is the inability to properly mount a canopy to the arch. The traditional method of mounting a canopy such as a boat canopy is to use snaps. With an arch, the snaps are mounted directly to the arch. As will be appreciated, this results in a large number of spaced snaps mounted across the arch. Typically, these snaps are quite visible and can take away from the boat's appearance. Additionally, the arch has a fairly flat surface that is curved at least at the transition between the top and the sides of the arch. The flat surface makes it difficult to get a good seal between the canopy and the arch particularly between the snaps. This is a considerable problem when the canvas is stretched from the arch back to the aft section of the boat. As will be appreciated, when the boat is moving through the water, the air and water hitting the arch can work its way under the snaps of the aft extending canopy and enter the cockpit area.

The curvature of the arch also creates difficulties. The canopy areas between the snaps have a tendency to not properly mate with the surface of the arch along curved portions. With the canopy being flat, when it is stretched over the curved arch it can have raised or puckered areas. The snaps are also difficult to secure, particularly along a curved portion because of the need to stretch the canopy over the curved area to properly align the snaps. There are also problems with the expansion and contraction of the boat canopy with temperature variations.

SUMMARY OF THE INVENTION

The present invention overcomes these problems by providing one or more water direction channels to direct water along the arch away from the cockpit area. In the preferred embodiment, the channel includes a snapless mounting feature to allow a canopy to be attached directly to the arch without the use of snaps. The channel provides both a water directing feature to direct the water along the exterior of the arch to the side of the boat and an aesthetically appealing mounting system for mounting the canopy directly to the arch.

The arch includes spaced side members extending upwardly from the port and starboard sides of the boat and a top member connecting the side members and spanning the cockpit area of the boat. The channel is configured to receive water and channel the water across the top and down the sides of the boat arch and away from the boat cockpit area.

The channel extends at least partially along the top of the arch and at least partially down each side of the arch. In the preferred embodiment, the channel extends across the length of the top and down the length of each of the arch sides.

In the preferred embodiment, the channel is formed into the outer surface of the arch and is defined by a recessed groove. The channel includes sidewalls and a base. Preferably, the channel is molded into the arch when the arch is formed. However, the channel can be cut into the arch. Additionally, more than one channel can be formed depending upon the size of the arch, the amount of water which is desired to be channeled and the desired appearance of the arch. Further, the channels can include both partial channels extending partially across the top member and down the side member in combination with similar channels or channels extending all the way across the top and down each side.

In a further preferred embodiment, the groove of the channel can be configured with a locking strip for connecting the canopy to the arch without the use of snaps. The locking strip includes at least one and preferably two fastening channels for fastening the boat canopy to the arch. The fastening channels are adjacent one another and each channel has a restricted opening defined by a locking finger that partially closes the channel. The canopy has a mating locking tab that zips into the channel locking strip. Additionally, a header assembly can be mounted to the boat windshield which includes the same fastening channel(s) for fastening the boat canopy to the windshield. Still further, the same type of fastening channels can be used along the perimeter of the boat cockpit for fastening the canopy to this area of the boat.

A locking tab is mounted to the edge of the canopy and is adapted to be locked into the fastening channels by merely pressing along the length of the locking strip. One edge of the locking tab has locking flanges for insertion into the fastening channels of the locking strip. The locking flanges are designed to mate with the fastening channels with each of the locking flanges having a locking recess for receipt of the locking finger of the fastening channels.

The boat canopy can be repeatedly connected to and disconnected from the arch, windshield or cockpit perimeter. To connect the canopy, the locking flanges are positioned against the channels of the locking strip and pressed along the length of the locking tab to force the locking flanges into the fastening channels. The locking tab can be removed from the fastening channels by pulling the tab in a direction generally perpendicular to the locking strip to disengage the flanges from the channels.

The use of a locking strip with fastening channels provides the dual purpose of a snapless locking system along with water channeling. The fastening channels direct the water in the same manner as the channel.

The snapless fastener also provides a watertight seal. The connection of the locking tab and the locking strip is along the entire length of these two members. There is no interruption as there is with snaps. Therefore, regardless of whether the canopy extends to the fore or aft sections, there is a watertight seal. Still further, this watertight seal is achieved along the curved surfaces of the arch. Pressing the locking tab into the locking strip along a curve provides the same seal and requires the same effort as required with a flat surface.

In a still further embodiment of the present invention, the locking strip can be mounted directly to the surface of the arch and not within a recessed channel. In this way, the water channeling function is still achieved along the arch, but the need for a groove is eliminated. As with the channel, the surface mounted locking strip will receive water within the fastening channels and direct that water along the length of the strip from the top down along the sides of the arch.

In still another embodiment, the locking strip configuration is molded into the arch or boat cockpit perimeter. In this embodiment, the locking strip is not a separate piece, but is integrally formed as a groove in the surface. The locking tab of the canopy is zipped into the specially formed channel.

The present invention provides an improved boat arch and canopy fastening system that makes fastening the canopy quick and easy and provides a very sleek aesthetically appealing canopy.

BRIEF DESCRIPTION OF THE DRAWINGS

FIG. 2 is a cross sectional view of a locking strip mounted within the channel of the arch.

FIG. 3 is a partial perspective view of the locking tab of the present invention.

FIG. 4 is a partial perspective view of a further embodiment of the locking strip.

FIG. 5 a perspective view of a still further embodiment of the locking strip.

DETAILED DESCRIPTION OF A PREFERRED EMBODIMENT

Figure 1:
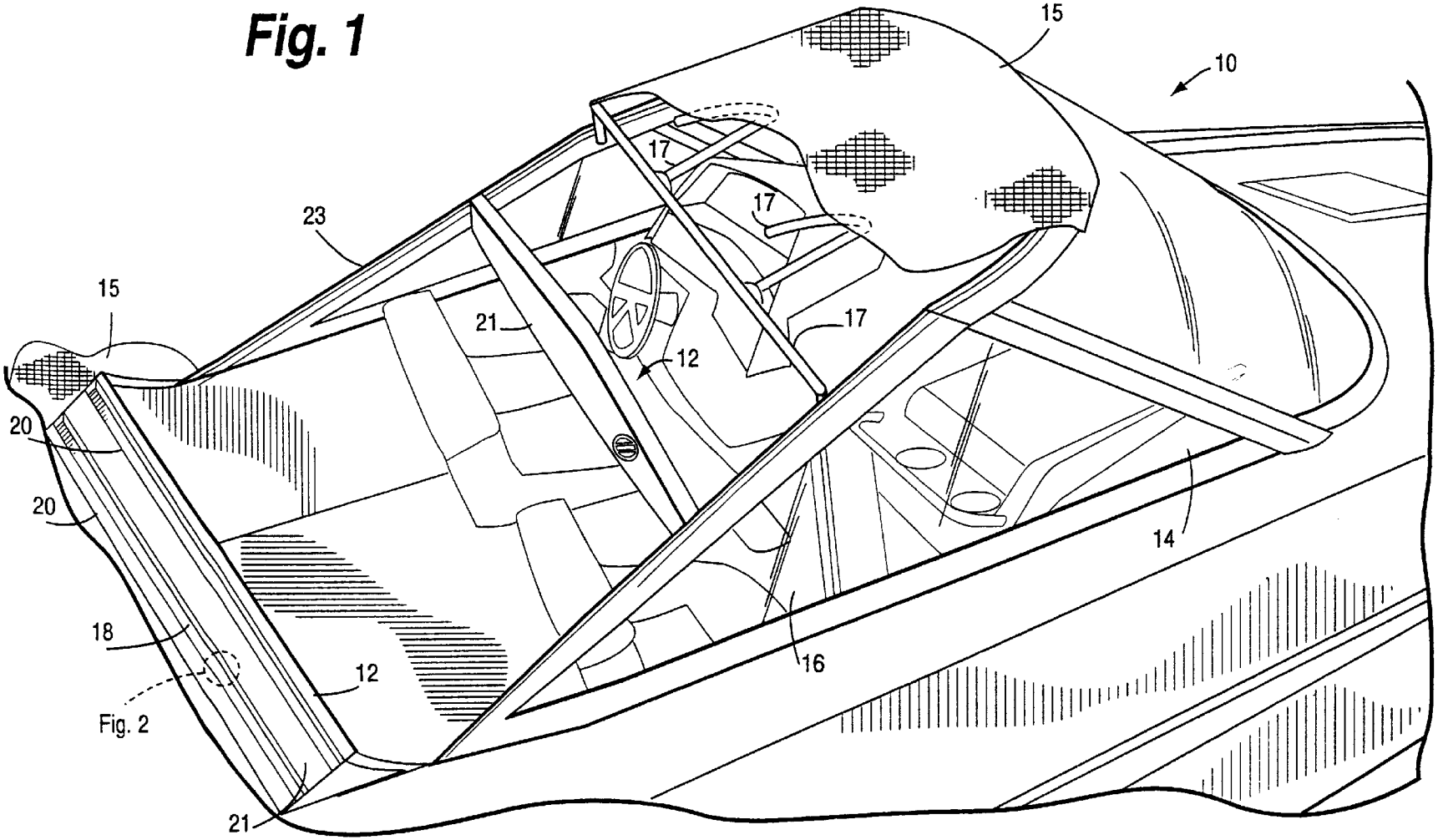
FIG. 1 is a partial perspective view of a boat having an arch with the channel of the present invention.

With reference to FIG. 1, a boat is generally shown at 10 having an arch 12, windshield 14, and a cockpit area 16. A canopy 15 is stretched between the windshield 14 to the arch 12 and a second canopy 15 is stretched from the arch 12 to the boat aft section to enclose the cockpit area 16. Supports 17 are used to support the mid-section of each canopy 15. As will be appreciated by those of ordinary skill in the art, various support structures can be used depending upon the style of boat and the aesthetic affect desired from the stretched canvas.

As shown in FIG. 1, the arch 12 has channels 18 formed along the arch. In the illustrated embodiment, there are two spaced channels 18, but it should be understood that a single channel 18 or a plurality of channels could be used. In addition, the illustrated channels 18 extend along the outer surface of sides 21 and along the length of the top member 23. The channel 18 may be designed to only extend partially along the top member 23 and partially down the side members 21 and still provide the desired water channeling.

The channel 18 includes a bottom surface 25 and walls 27 which can be seen in greater detail in FIG. 2. As water contacts the arch 12 it is received within the channels 18. The channels 18 as illustrated are recessed within the arch and the water is channeled along the channel to the port or starboard side of the boat and then discharged to prevent the water from entering the cockpit area 16.

In the preferred embodiment, the channel 18 is formed in the arch when the arch 12 is manufactured. Other methods of forming the arch will be apparent to those of ordinary skill in the art including the use of a router to rout a channel 18 into an arch 12 to retrofit an existing arch.

With reference to FIG. 2, a locking strip 20 has been mounted within the channel 18. In the preferred embodiment the strip 20 is formed from extruded aluminum, but could be made of other materials, such as for example, plastic, rolled stainless steel or fiberglass. The strip 20 is generally E-shaped in cross section and includes three legs, 22, 24 and 26. Each of these legs ends in a hook section 28 and define a fastening channel 30 for receipt of locking tabs 32 and 34 shown in FIG. 3. The fastening channels 30 preferably have a restricted opening defined by the hook portions 28 that partially close the fastening channels 30 and locks the tabs 32 and 34 into the fastening channels 30 when inserted.

The locking strip 20 thus has an upwardly facing open top channel with a closed bottom, and a substantially flat exterior surface 25' (e. g. see FIGS. 2, 4–6, 25, and 22) at the closed bottom, which surface 25' is mounted to the mounting surface 25 (see FIG. 2), held in place by the walls 27, or by screw fasteners (52, 62 in FIGS. 4 and 5), double sided foam tape (105 in FIGS. 19, 20, 22, and 24–26), welding, glue, or other known fastening means.

With reference to FIG. 3, the locking tabs 32 and 34 include flanges 36, 38 and 40 for insertion into the fastening channels 30. The locking flanges 36, 38 and 40 are designed to mate with the fastening channels 30 and in particular to hook under the hooks 28. The canopy 15 is mounted to the locking member 44 by stitching 46 or by other connecting methods, such as for example gluing, double sided tape, etc. It should be appreciated that the view in FIGS. 2 and 3 are only partial views. The strip 20 and member 44 are relatively long and extend along the arch as indicated in FIG. 1.

To connect the canopy 15, the locking member 44 is positioned against the locking strip 20 and the length of the locking member 44 is pressed against the strip 20 to force the locking flanges 32 and 34 into the fastening channels 30. The locking member 44 can be removed from the fastening channels 30 by pulling the member 44 away from the locking strip to disengage the flanges 32 and 34 from the channels 30.

An advantage of the snapless mounting system of the present invention is the ability to direct water down the channels of the strip 20 when the canopy is not present. The channels 30 will direct water along the arch away from the cockpit area 16.

With reference to FIG. 4, a further embodiment of the locking strip of the present invention is shown. In this embodiment, there is a connecting bar 50 formed integrally with the locking strip for receipt of fasteners 52. In the preferred embodiment, the locking bar 50 has a series of counter sunk openings for receipt of the fasteners 52. In this way, the strip can be attached by fasteners 52, such as for example screws, to the arch or other section of the boat. The locking strip of the present embodiment provides the added capability of being mounted to the arch 12 without having a channel 18 formed in the arch 12. The channel 18 allows the locking strip to be recessed into the arch, but it will also provide advantages if mounted directly to the outer surface of the arch 12 or other areas of the boat. As should be appreciated, the surface mounted locking strip will provide water channeling advantages similar to those provided by the recessed channel 18. The channels 30 will channel water across the arch and away from the cockpit area 16. Additionally, the locking strip provides the ability to mount the canopy 15 without the use of unsightly snaps.

Another embodiment of the locking strip 20 of the present invention is shown in FIG. 5. In this embodiment, there is a locking bar 60 which extends down the center of the strip and receives fastener 62. Furthermore, the strip has a plurality of spaced cuts 64. These cuts 64 have been formed so that the strip can bend around corners to closely follow the curved lines of the boat. Depending upon the curvature of the surface and material used, the need for such cuts 64 would be optional.

Figure 6:
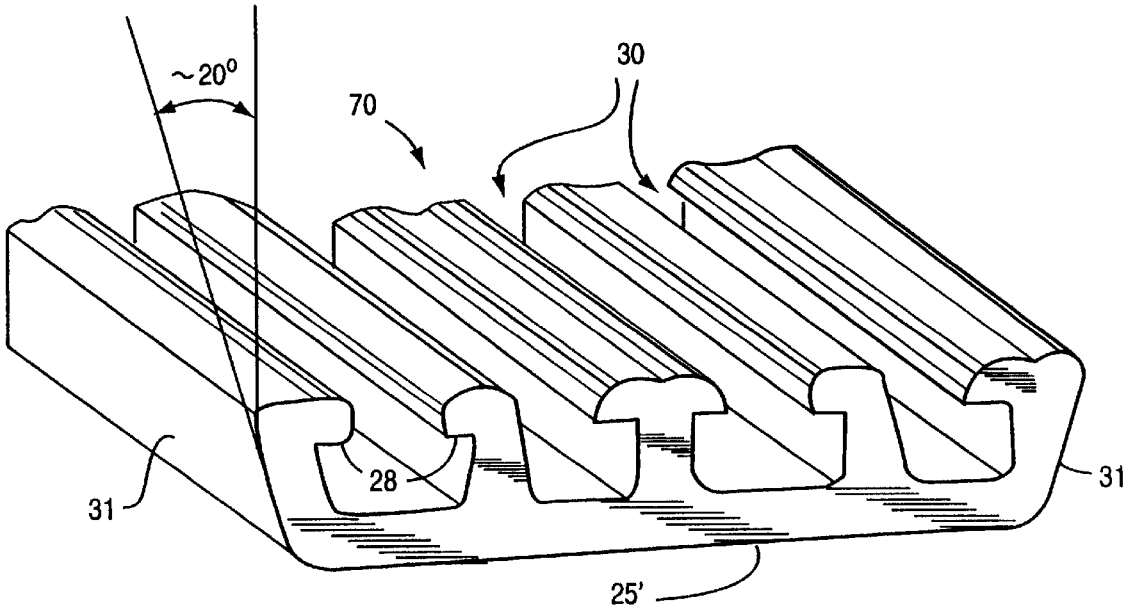
FIG. 6 is another embodiment of the locking strip of the present invention.

With reference to FIG. 6, a double locking strip 70 is shown. This double locking strip is used to mount both the fore and aft canvases 15 from the same channel 18. In this way, only one channel 18 would need to be formed for receipt of the double locking strip 70.

In the preferred embodiment, the locking strip shown in FIG. 2 is extruded from aluminum and has a width of about 0.849 inches and a height of about 0.313 inches. The sides 31 of the locking strip 20 have a draft angle of about 20° to facilitate fabrication and removal of the arch from the mod. The draft angle of about 20° can be seen in FIGS. 6 and 11, or—shown angled outwardly from the exterior bottom surface 25' rather than inwardly from the bottom surface 25'—in FIGS. 5 and 22. The channel-free sides 31 are angled not only with respect to the bottom surface 25', but also with respect to a line substantially perpendicular to the surface 25' (e.g. the vertical).

Figure 7:
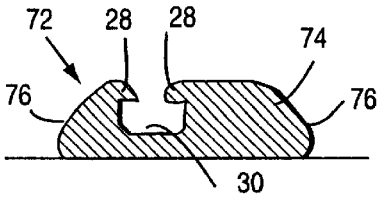
FIGS. 7 through 26 are several embodiments of the locking strip including various mounting options for connecting the mounting strip to a boat.

With reference to FIGS. 7 through 26, various alternative locking strip cross sections are illustrated. FIG. 7 illustrates a single channel locking strip 72. The locking strip 72 has hook sections 28 and a fastening channel 30. The portion 74 is intended to be the mounting region for receipt of a fastener which is not shown. In the alternative, the locking strip 72 could be fastened by other known fastening means such as for example, gluing, double-sided tape, welding, etc. The sides 76 of the locking strip 72 slope inwardly toward the channel 30 as opposed to outwardly. Angling the sides 76 inwardly reduces the amount of material used and adds to the aesthetics of the locking strip 72. Preferably strips 76 are mounted to the surface of the arch 12 or other areas of boat 10, but they could be mounted to a recessed channel as well.

Figure 8:
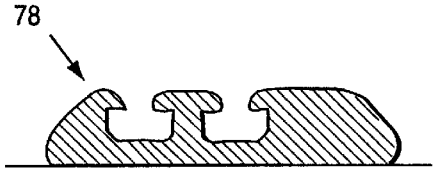
Figure 9:
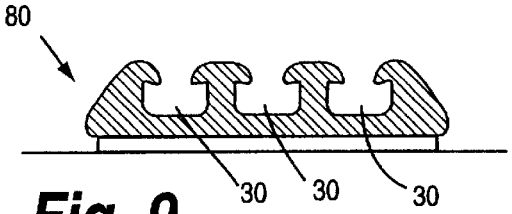

FIG. 8 illustrates a locking strip 78 which is similar to the locking strip 72 but includes an E-shaped cross section for receipt of two locking tabs instead of one. This strip 78 is intended to be mounted to a surface but again could be mounted within a channel. FIG. 9 illustrates a locking strip 80 which has three fastening channels 30. The locking strip 80 of FIG. 9 is a variation of FIGS. 7 and 8 and would accept a locking member 44 having two tabs and a separate locking member 44 having a single tab or a locking member having three locking tabs.

Figure 10:
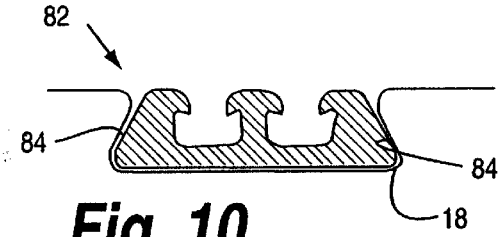

FIG. 10 illustrates a locking strip 82 intended to be mounted within a channel 18 but with the sides 84 angled inwardly toward the channel 30 as opposed to outwardly as in previously described channel mounted locking strips. The advantage of angling the sides 84 inwardly is that when the strip 82 is received within the mating channel 18, the mating inwardly sloping sides lock the strip 82 within the channel 18.

Figure 11:
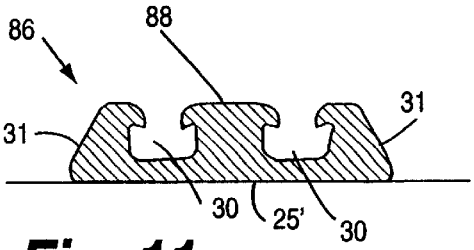
Figure 12:
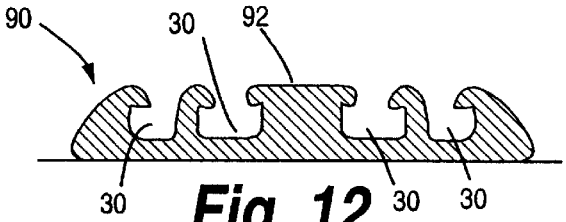

FIG. 11 illustrates a locking strip 86 which has a mounting region 88 between the channels 30. This strip 86 is similar to the strip illustrated in FIG. 5. The mounting region 88 is designed to receive fasteners such as screws for fastening the strip 86 to the surface of the arch or other area of the boat. FIG. 12 illustrates a locking strip 90 which has a pair of fastening channels 30 separated by a mounting area 92. Again, the mounting area is designed to receive for example screws for mating locking tabs 44. As it will be appreciated that the locking tab illustrated in FIG. 3 would be adapted for receipt by the locking strips 108 illustrated in FIGS. 18, 19 and 22 while the locking strips 110 in FIGS. 20 and 26 would receive a locking member 44 having two locking tabs 32 with flanges 36 and 38. The locking strips 112 illustrated in FIGS. 21, 23, 24 and 25 would receive a locking member 44 having a single locking tab 32 having flanges 36 and 38.

Figure 27:
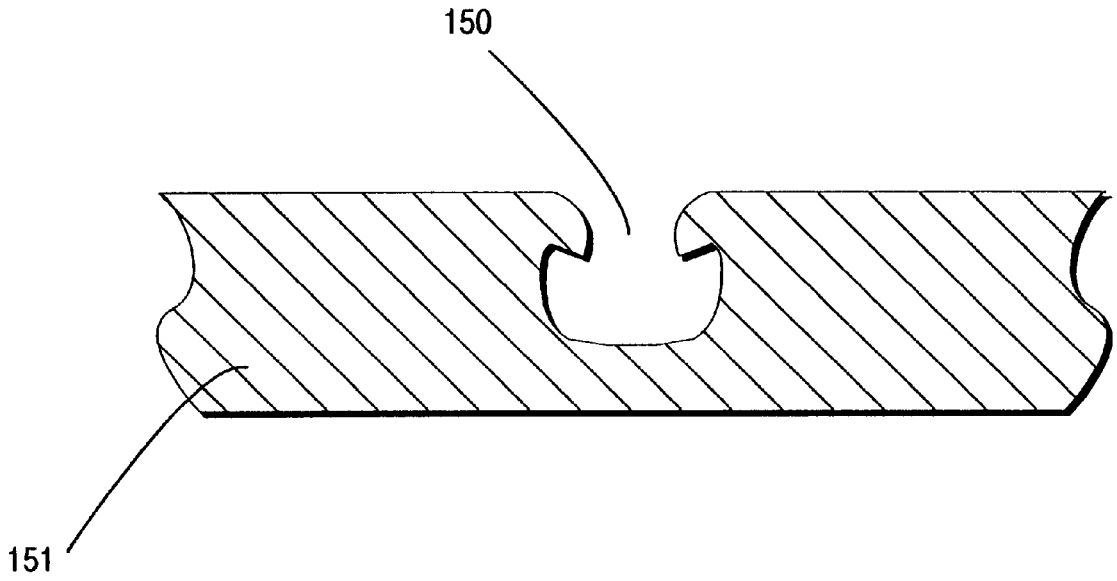
FIG. 27 is cross-sectional view of the locking strip formed integrally into the surface.

FIG. 27 shows a locking strip 150 that is integrally formed in the surface 151, in this embodiment, the strip is not a separate member.

It should be appreciated, that the mounting system of the present invention is not limited to the marine industry or attachment to a windshield or arch. The mounting system could also be used on automobiles, trucks, recreational vehicles, buildings, spas, etc. Additionally, the mounting system could be used on flat surfaces as well as curved surfaces, or free standing members, such as the support members for a bimini style top.

Figure 13:
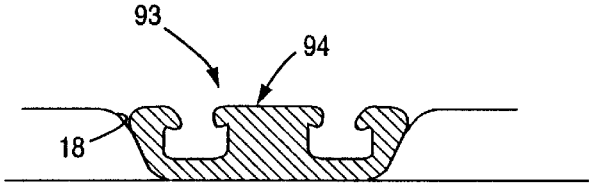

Having described various preferred embodiments of the present invention, it should be realized by one of ordinary skill in the art that the present invention may be modified without departing from the inventive concepts as set forth in the following claims. fastening the strip 90 to the surface of the boat. FIG. 13 shows a locking strip 93 which is adapted to be mounted within a groove 18 and includes a mounting region 94. Region 94 receives for example screws for mounting the strip within the groove 18.

Figure 14:
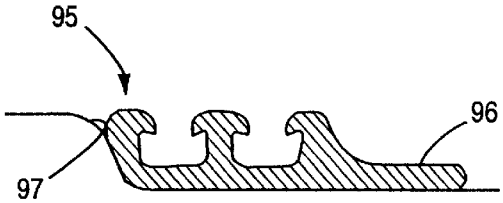

FIG. 14 illustrates an E-shaped cross section of a locking strip 95 that includes a locking region 96 extending outwardly from one side of the locking strip 95. This locking strip 95 is particularly adapted for mounting to a sloping wall 97.

Figure 15:
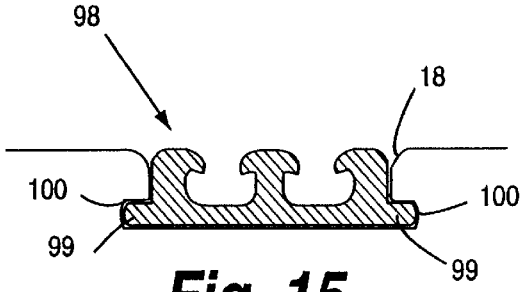

FIG. 15 illustrates a locking strip 98 which is similar to the locking strip 82 illustrated in FIG. 10. In this locking strip 98, retaining tabs 99 are formed at the base. The retaining tabs 99 mate with an inset area 100 formed in the channel 18. The mating of the tabs 99 and inset 100 maintains the locking strip 98 within the channel 18. The tabs 99 or inset 100 could be interrupted along the length of the strip 98 or channel 18. In other words, the tabs 99 and inset 100 do not have to extend the length of the strip 98 or channel 18.

Figure 16:
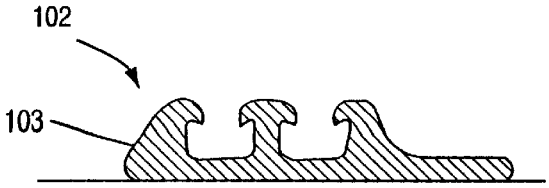
Figure 17:
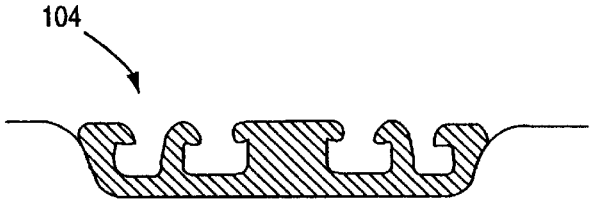
Figure 18:
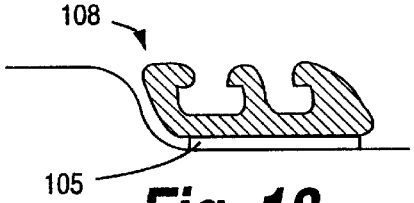
Figure 19:
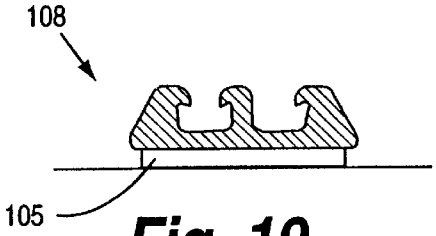
Figure 20:
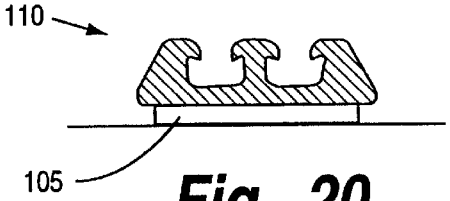
Figure 21:
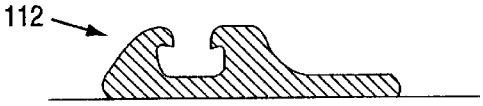
Figure 22:
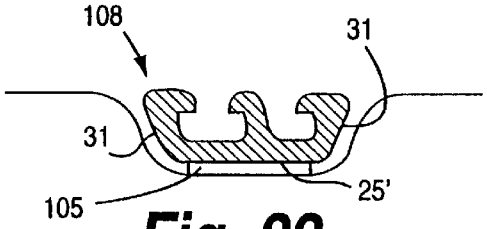
Figure 23:
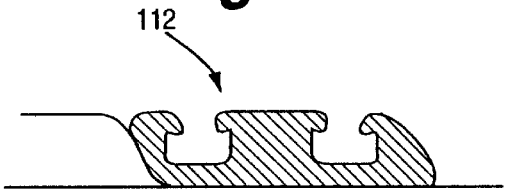
Figure 24:
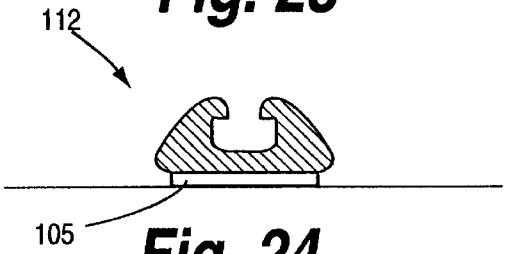
Figure 25:
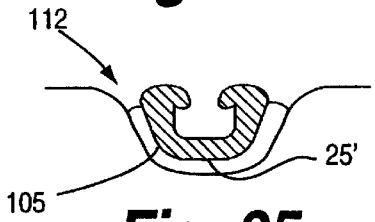
Figure 26:
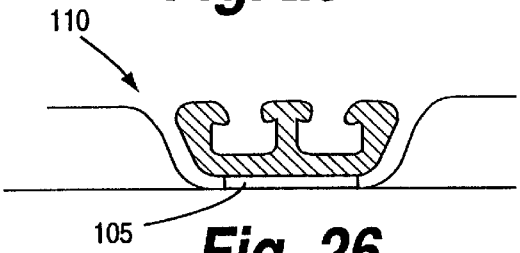

FIG. 16 illustrates a locking strip 102 which is similar to that illustrated in FIG. 14 with the exception that the side 103 slopes inwardly as opposed to outwardly. It is preferred that the strip 102 be mounted to the surface of the boat without engaging either the sloping walls of channel 18 or other sloping walls of the boat.

With reference to FIGS. 18 through 20, 22, 25 and 26, a double-sided foam tape 105 has been used to mount the various style locking strips to the boat surface or within a channel. The various configurations of the locking strips in these embodiments are similar to those previously discussed and are adapted to receive

What is claimed is:

1. An improved boat arch comprising:

spaced side members joined by transition areas to a top member;

said side and top members having an outer surface adapted to face away from the cockpit area of a boat and an inner surface adapted to face towards the cockpit area of a boat;

said side members being adapted to extend upwardly from the port and starboard sides of a boat and said top member being adapted to span the cockpit area;

at least one channel extending at least partially along said port and starboard sides and at least partially across said top member; on the outer surface of said arch;

said channel extending at least partially along said top member and at least partially down said side member such that said channel traverses said transition areas between said top member and side members;

whereby said channel is adapted to receive water and channel said water along said channel down said side members and away from said cockpit area of said boat.

2. The improved boat arch of claim 1, wherein said channel has an elongated recess defined by a base and sidewalls; said recess extending at least partially along said top member and at least partially down said side members.

3. The arch of claim 1, wherein said channel extends across the top member and substantially down the length of each of said side members.

4. The arch of claim 1, wherein said arch includes more than one channel.

5. The arch of claim 3, wherein said arch includes more than one channel.

6. The arch of claim 1, wherein said channel is recessed into the outer surface of said arch.

7. The arch of claim 1, wherein said channel is mounted to the outer surface of said arch.

8. The arch of claim 1, wherein said channel includes at least one recess having a restricted opening.

9. The arch of claim 8, wherein said channel is mounted to the outer surface of said arch.

10. The arch of claim 8, wherein said channel is recessed into the outer surface of said arch.

11. The arch of claim 8, wherein said channel has a restricted opening and is formed in a strip for mounting two said top and side members.

12. The arch of claim 1, wherein said channel includes a groove recessed into the outer surface of said arch and a locking strip having at least one channel with a restricted opening is mounted within said groove for receipt of a canopy.

13. The arch of claim 8, further including a locking member and canopy, said locking member being mounted to said canopy and including locking tabs adapted to be received within said restricted openings of said channel to attach said canopy to said arch.

14. The arch of claim 12, further including a locking member and canopy, said locking member being mounted to said canopy, said locking member including locking tabs adapted to be received within said restricted opening of said channel to attach said canopy to said arch.

15. A canopy retaining assembly for retaining a canopy, said retaining assembly comprising:

a locking strip on a mounting surface;

said strip including at least one fastening channel for fastening a canopy, said fastening channel having a restricted opening defined by at least one locking tab partially closing said channel, said channel having an upwardly facing open top and a closed bottom;

said strip having a substantially flat exterior surface at said closed bottom, on said mounting surface;

a canopy locking member attached to said canopy, said canopy locking member including at least one resilient locking flange for insertion into said at least one fastening channel, said locking flange having a locking recess for receipt of said locking tab of said at least one fastening channel and a re-entrant protrusion for engagement into said re-entrant groove of said at least one fastening channel; and wherein a canopy can be repeatable connected to and disconnected from said locking strip by forcing said locking flanges into said at least one fastening channel by positioning said locking flanges adjacent to said at least one fastening channel and thereafter pressing against said canopy locking member to force said flanges into said at least one fastening channel by pulling said locking member away from said strip to disengage said flange from said at least one fastening channel.

16. The canopy retaining assembly of claim 15, wherein said strip is extruded from aluminum.

17. The canopy retaining assembly of claim 15, wherein said locking strip includes more than one channel and said locking tab includes more than one locking flange.

18. The canopy retaining assembly of clam 15, wherein said locking strip includes a mounting portion for receipt of fasteners for fastening said locking strip to said mounting surface.

19. The canopy assembly of claim 15, wherein the sides of said locking strip are angled with respect to vertical and to said substantially flat surface to facilitate manufacture.

20. The canopy retaining assembly of claim 15, further including a boat arch comprising said mounting surface to which the locking strip is mounted.

21. The canopy retaining assembly of claim 20, wherein the locking strip is mounted to the outside surface of the boat arch.

22. The canopy retaining assembly of claim 20, wherein the locking strip is mounted to the inside surface of the boat arch.

23. The canopy retaining assembly of claim 20, wherein the locking strip is mounted to the edge of the boat arch.

24. The canopy retaining assembly of claim 15, wherein said locking strip is mounted to said mounting surface by double sided foam tape, glue, welding, or screw fasteners.

25. The canopy retaining assembly of claim 15 further comprising a perimeter of a boat cockpit defining said mounting surface, so that said locking strip is mounted on said perimeter of said boat cockpit.

26. The canopy retaining assembly of claim 15 further comprising a portion of said locking strip comprising at least one countersunk through-extending opening therein extending substantially perpendicularly to said substantially flat surface thereof, said at least one opening for receiving a metal fastener therein.

* * * * *